US009319795B2

(12) United States Patent
Qu et al.

(10) Patent No.: US 9,319,795 B2
(45) Date of Patent: Apr. 19, 2016

(54) METHOD AND APPARATUS FOR MINIMIZING OR PREVENTING INTERFERENCE OF TWO-WAY RADIO SPEAKER MICROPHONES CAUSED BY FINE METAL PARTICLES

(71) Applicant: Anray International Corp., Orange, CA (US)

(72) Inventors: Haijuan Qu, Yorba Linda, CA (US); Liren Lin, Corona, CA (US)

(73) Assignee: Anray International Corp., Orange, CA (US)

( * ) Notice: Subject to any disclaimer, the term of this patent is extended or adjusted under 35 U.S.C. 154(b) by 9 days.

(21) Appl. No.: 14/199,986

(22) Filed: Mar. 6, 2014

(65) Prior Publication Data

US 2015/0131844 A1 May 14, 2015

Related U.S. Application Data

(60) Provisional application No. 61/902,009, filed on Nov. 8, 2013.

(51) Int. Cl.
*H04R 9/02* (2006.01)
*H04R 1/02* (2006.01)

(52) U.S. Cl.
CPC ..... *H04R 9/025* (2013.01); *H04R 1/023* (2013.01); *H04R 2400/01* (2013.01)

(58) Field of Classification Search
CPC ..... H04R 9/02; H04R 9/06; H04R 13/02; H04R 1/023; H04B 1/385; H04B 1/44
See application file for complete search history.

(56) References Cited

U.S. PATENT DOCUMENTS

| | | | | |
|---|---|---|---|---|
| 4,281,224 | A * | 7/1981 | Castagna | 381/391 |
| 6,259,800 | B1 * | 7/2001 | Tagami | H04R 9/06 381/398 |
| 6,862,361 | B2 * | 3/2005 | James | H04R 9/046 181/171 |
| 8,440,926 | B2 * | 5/2013 | Stiehl et al. | 200/406 |
| 8,712,091 | B2 * | 4/2014 | Taylor | H04R 1/023 381/345 |
| 2004/0170297 | A1 * | 9/2004 | Hikichi | 381/430 |
| 2006/0050917 | A1 * | 3/2006 | Skillicorn | H04B 1/385 381/384 |
| 2009/0003632 | A1 * | 1/2009 | Lin | H04R 9/025 381/182 |
| 2010/0046785 | A1 * | 2/2010 | Schmidt | H04R 1/025 381/387 |
| 2012/0033846 | A1 * | 2/2012 | Kaplan | H04R 1/023 381/386 |
| 2013/0189918 | A1 * | 7/2013 | Miyata | F24F 7/00 454/254 |
| 2014/0146995 | A1 * | 5/2014 | Adelman | H04R 11/02 381/414 |

* cited by examiner

*Primary Examiner* — Fan Tsang
*Assistant Examiner* — Angelica M McKinney
(74) *Attorney, Agent, or Firm* — WPAT, P.C., Intellectual Property Attorneys; Anthony King; Kay Yang

(57) ABSTRACT

A speaker microphone design that prevents, eliminates, and/or minimizes speaker mechanical failure caused by fine metal particles in the ambient environment. The contemplated invention includes embodiments that utilize one or more barrier cover installed at a location between the speaker diaphragm and the grille. The barrier cover can be a thin shell of various shapes and sizes, such as a dome-shaped structure. In other embodiments, the barrier cover can be a thin membrane, such as a Bayer® film. Additionally or alternatively, the speaker is positioned further back away from the grille, to provide a clearance space of at least 10 mm between the diaphragm and the grille. This novel design of clearance is also effective in preventing, eliminating, and/or minimizing speaker mechanical failure caused by fine metal particles in the environment.

17 Claims, 8 Drawing Sheets

METHOD AND APPARATUS FOR MINIMIZING OR PREVENTING INTERFERENCE OF TWO-WAY RADIO SPEAKER MICROPHONES CAUSED BY FINE METAL PARTICLES

CROSS-REFERENCE TO RELATED APPLICATIONS

This application claims priority to U.S. Provisional Pat. No. 61/902,009, filed on Nov. 8, 2013, now pending, which is hereby incorporated by reference in its entirety. Although incorporated by reference in its entirety, no arguments or disclaimers made in the priority application apply to this application.

BACKGROUND OF THE INVENTION (1) Field of the Invention

The field of the invention is speaker microphone for two-way radios.

(2) Description of Related Art Including Information Disclosed Under 37 CFR 1.97 and 1.98

Two-way radios are known in various industries to provide a way of communication where user of a two-way radio can both transmit and receive signals with other similar radios operating on the same radio frequency (channel). Two-way radios are available in mobile, permanent base and hand-held portable configurations. Various types of accessories, such as a speaker microphone, are available for use with a hand-held portable two-way radio. Speaker microphones can be clipped onto a user's epaulet, belt, shirt, or any part of a working uniform.

It is a well-known problem that speaker microphones have a much shortened functional lifespan in machine shops, autobody shops, automobile assembly lines and factories. The speakers inside of the speaker microphone tend fail after a few months in such environment. Oftentimes, these speaker microphones fail at times when communication was most urgent during emergency, without prior warning. There has been no previous solution to prevent such early and sudden mechanical failure. Typically, the solution in the industry is to purchase new speaker microphones to replace broken ones.

Therefore, there is a need for new ways to prevent, minimize, or eliminate such early mechanical failure of speaker microphones commonly found in machine shops, autobody shops, automobile assembly lines and factories.

Further, there exist a desire to modify, retrofit, or improve existing speaker microphones without having to modify the size and shape of the speaker microphone housing, and still capable to prevent, minimize, or eliminate such early mechanical failure of speaker microphones commonly found in machine shops, autobody shops, automobile assembly lines and factories.

All referenced patents, applications and literatures are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply. The invention may seek to satisfy one or more of the above-mentioned desires. Although the present invention may obviate one or more of the above-mentioned desires, it should be understood that some aspects of the invention might not necessarily obviate them.

BRIEF SUMMARY OF THE INVENTION

The inventive subject matter as disclosed herein provides a method to prevent, eliminate, minimize, undesirable interferences caused by fine metal particles to speaker microphones. There are currently no solutions in the industry to solve such debilitating costly problem. And depending on the environment to which the speaker microphone is used, a brand new prior art speaker microphone can be rendered useless in as little as 30 days, as a result of fine metal particle interference.

The inventors have discovered novel methods and designs which are proven to prevent, eliminate, and/or minimize, such undesirable interferences. One of the key elements of the inventive subject matter is having an appropriately sized barrier cover to block passage of any fine metal particles from passing through and reaching the diaphragm of the speaker. Or, to have appropriately sized barrier cover to keep all fine metal particles at a safe distance away from the permanent magnet so that even if the metal particles are still attracted to the speaker microphone (and attached an outer perimeter region of the diaphragm, or attached to the barrier cover), it would only have minimal effect on diaphragm vibration. The barrier cover is broadly defined as any appropriately sized membrane or shell structure, with an appropriate thickness so as have minimum effect on sound transmission through the barrier cover. In one embodiment, this barrier cover is a dome-shaped structure directly and sealingly attached to the diaphragm. In another embodiment, this barrier cover is a membrane sealingly attached to inside of the grille of the speaker microphone housing. In yet another embodiment, the contemplated speaker microphone contains both of the above two types of barrier covers, that is, the dome-shaped structure disposed on the diaphragm, and the membrane attached on the grille of the speaker microphone housing. In further other embodiments, the shell structure can be in other shapes, and can be placed in various other locations other than directly onto the diaphragm. Additionally or alternatively, certain embodiments can include an added distance between the diaphragm and the grille of the speaker microphone. The added distance has been proven to greatly minimize the strength of magnetic attraction made available by the permanent magnet on the fine metal particles through the grille. In one preferred embodiment, the added distance is made possible by placing a short ring spacer having a diameter similar to that of the speaker (diameter X), in between the speaker and the grille. Of course, many other methods and physical structure to create this added distance are possible and contemplated, all of which will be discussed in more details below.

As discussed above, one goal of the inventive method is to keep fine metal particles as far away from the magnetic gap of the speaker as possible. As will be discussed below, one embodiment uses a dome-shaped structure sealingly attached to the diaphragm. The dome-shape structure prevents direct attachment of any environmental fine metal particles to at least the center portion the diaphragm closest to the magnetic gap. While there may still be sufficient magnetic attraction to cause some fine metal particles to attach to the dome-shaped structure, or around the rim of the dome-shaped structure, or on the perimeter region of the diaphragm not covered by the dome-shaped structure, the strength of magnetism at those locations is much weaker, thus those attached metal particles would have little effect on diaphragm vibration.

In one preferred embodiment, the contemplated speaker microphone has a body having an outer casing, and the outer casing has a front grille and a back portion. This outer casing encloses a speaker, and the speaker has a diaphragm with outer circumference and a diameter X. As a typical speaker would, this speaker has a magnet, a magnetic gap, and a voice coil disposed within the magnetic gap and coupled to the diaphragm. The diaphragm is generally disposed between the front grille and the magnet. At least one barrier cover (either type of barrier cover) is disposed at a location between the front grille and the diaphragm to physically prevent passage of a fine metal particles therethrough.

As mentioned, the contemplated barrier cover can be in various different forms, shapes, and materials. For example, it can be a membrane, a dome structure, a cone structure, or a short cylindrical structure with a closed top.

In one preferred embodiment, the barrier cover is sealingly coupled to the diaphragm to create a closed chamber defined as a space between the diaphragm and the barrier cover. This closed chamber is physically sealed to prevent entry of fine metal particles into the closed chamber. One of the purposes of this closed chamber is to create an appropriate distance between fine metal particles and the magnetic gap. Preferably, this barrier cover is a thin dome-shaped shell.

In further preferred embodiments, the barrier cover has a circular outer rim with diameter Z, and the optimal size and range of this diameter Z is a function of diameter X. A barrier cover with too small or too large of a diameter in relation to the diaphragm would not achieve the desired novel effect. In most preferred embodiments, diameter Z must be smaller than diameter X.

As will be discussed in more details later, in one embodiment, the contemplated dome-shaped barrier cover has a concave side and convex side, and the convex side of the dome faces the front grille, whereas the concave side of the dome-shaped barrier cover faces the diaphragm. In this configuration, the rim of the barrier cover is directly attached to the diaphragm. Most preferably, the dome structure is sufficiently thin to have minimum effect on sound transmission, or to have minimum effect on producing sound as the dome structure itself vibrates along with the diaphragm, and is comprised of polyester.

In some embodiments, the barrier cover can be a membrane, such as a Bayer® film, and is disposed directly behind the grille. Other types of membrane can be used so long as it is sufficiently thin so as to have minimum effect on sound transmission.

In most preferred embodiments, the speaker microphone has both the dome-shaped barrier cover and the membrane-type barrier cover installed as a double protection against entry of fine metal particles.

Still further contemplated embodiments utilizes methods to position the speaker further away from the front grille of the outer casing so as to provide a clearance distance of at least 10 mm between the outer circumference of the diaphragm and an inner-facing side of the front grille. In some embodiments, this clearance distance is at least 5 mm. In some other embodiments, this clearance distance is at most 15 mm. In further embodiments, the clearance distance is at most 20 mm.

In some embodiments, the barrier cover is preferably directly attached to the diaphragm so that the barrier cover vibrates along with the diaphragm to produce sound.

The various summarized structures and methods above provide a way to prolong the functional lifespan of a speaker microphone against deteriorating effects of environmental fine metal particles. Various objects, features, aspects and advantages of the present invention will become more apparent from the following detailed description of preferred embodiments of the invention, along with the accompanying drawings in which like numerals represent like components.

BRIEF DESCRIPTION OF THE DRAWINGS

It should be noted that the drawing figures may be in simplified form and might not be to precise scale. In reference to the disclosure herein, for purposes of convenience and clarity only, directional terms, such as, top, bottom, left, right, up, down, over, above, below, beneath, rear, front, distal, and proximal are used with respect to the accompanying drawings. Such directional terms should not be construed to limit the scope of the invention in any manner.

DETAILED DESCRIPTION OF THE INVENTION

The invention and its various embodiments can now be better understood by turning to the following detailed description of the preferred embodiments, which are presented as illustrated examples of the invention defined in the claims. It is expressly understood that the invention as defined by the claims may be broader than the illustrated embodiments described below.

Figure 2:
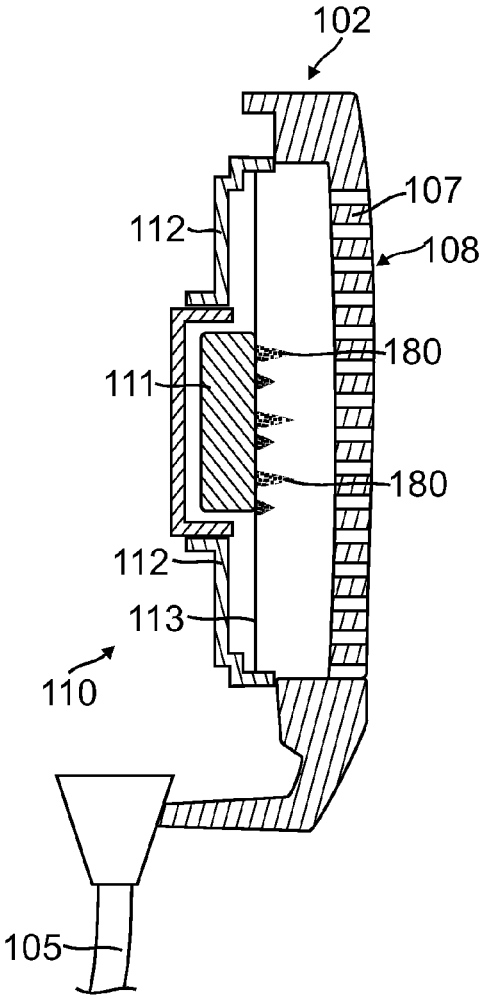
FIG. 2 (PRIOR ART)
FIG. 2 is a side cross-sectional view of the prior art speaker microphone of FIG. 1, showing only the front half of the casing along with the small speaker, and the back half of the housing is removed along with the electrical components for simplified illustration.

While not wishing the be bound by any theory or hypothesis, the inventors contemplate a number of reasons that fine metal particles interfere with functional properties of a speaker in a speaker microphone, and how they eventually disable the speaker from projecting/producing sound. According to one theory, fine metal particles 180 in the environment may enter into the housing 102 of prior art speaker microphones through the openings 108 in its grille 107. As shown in FIG. 2, fine metal particles 180 accumulate on the surface of speaker diaphragm 113 after they enter through the grille 107. As permanent magnet 111 attracts these fine metal particles 180, the exerted magnetic field pulls the fine metal particles 180 towards the permanent magnet 111 (or more specifically in theory, towards the magnetic gap G, where the magnetic pull is the strongest), and fine metal particles 180 in turn exert a constant force on to the speaker diaphragm 113 towards the left side of FIG. 2. As fine metal particle 180 accumulate over time, the accumulated mass of fine metal particles 180 exert more and more force on to the speaker diaphragm 113, and it becomes more and more difficult for the speaker diaphragm 113 to move (as driven by the voice coil, not shown) and vibrate as intended to project sound, eventually rending the speaker 110 useless.

While illustration of speaker 110 of FIG. 2, and likewise the illustrations of speakers 10 of all other figures are drawn in generalized dimensions and shapes, one skilled in the art would immediately recognize the construction of such prior art small speaker 110, 10, having a frame 112, 12 to house the diaphragm 113, 13, and the permanent magnet 111, 11. While the voice coil is not shown, one skilled in the art would understand that the prior art voice coil is generally disposed around the perimeter of the magnet 111, 11, and its movement relative to the magnet 111, 11 in turn causes vibration of the diaphragm to which it is attached.

The inventors have discovered new designs, and/or methods to retrofit existing speaker microphone designs so as to eliminate, prevent, and/or minimize the unwanted and disabling interference from fine metal particles. The contemplated inventive subject matter includes methods, as well as structures and parts necessary to achieve the objective.

The speaker microphone of the contemplated embodiments uses 1.5 inch small speakers. Although other sizes of speakers can be used and implemented for this invention, the industry overwhelmingly uses 1.5 inch small speakers in speaker microphones for two-way radios. As such, unless otherwise specifically noted, the discussion in this specification regarding speakers is for 1.5 inch small speakers, more specifically 1.5 inch 1 watt speakers having generally flat diaphragms. The disclosure in the instant application specifically excludes speakers larger than 2 inches, speakers in home stereo systems, speakers not typically used in two-way radios, and speakers not typically used in speaker microphones. The speaker discussed herein for the contemplated anti-interference design can already have a dust cap in place (e.g., a flat dust cap). The small speaker discussed herein and contemplated for the invention can also have a flat diaphragm design having no such dust caps. Although, more than 95% of all 1.5 inch small speakers for speaker microphones do not use dust caps.

Figure 1:
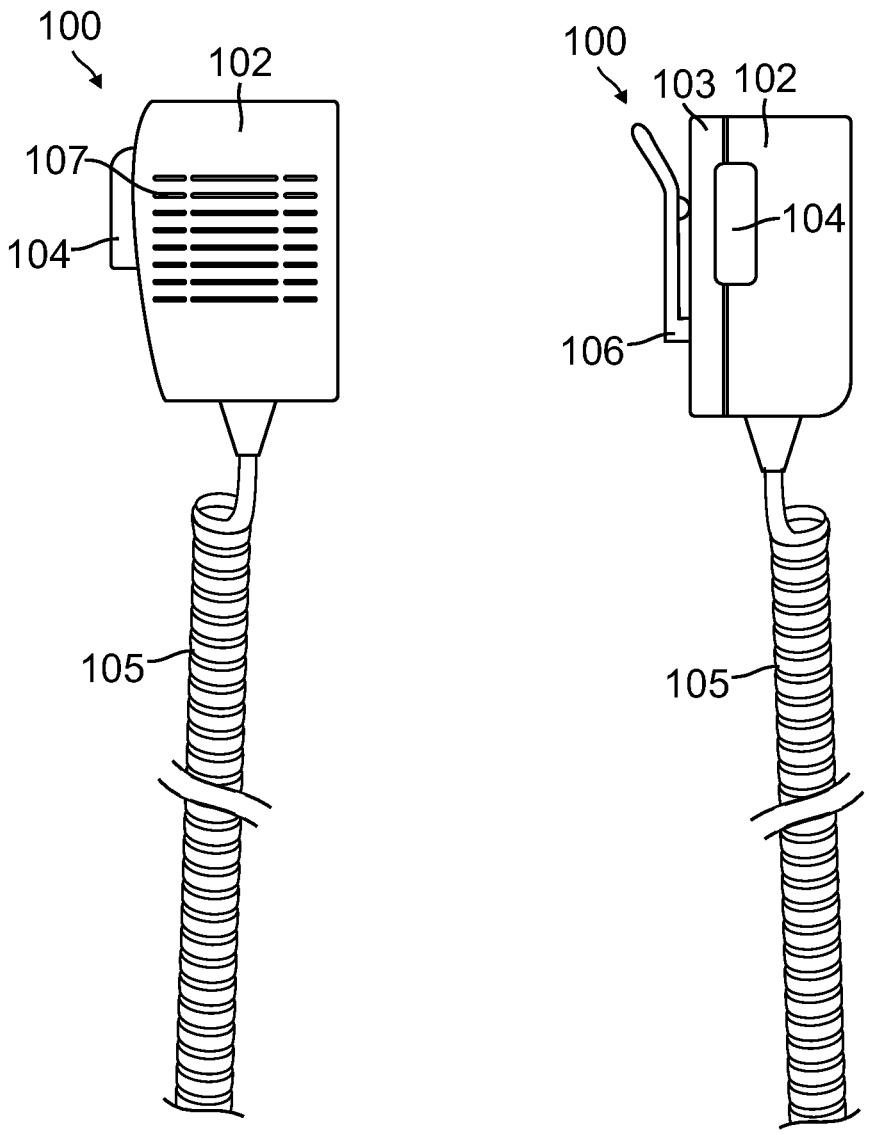
FIG. 1 (PRIOR ART)
FIG. 1 is a side view and front view of a prior art speaker microphone.

As already briefly described above and illustrated in FIGS. 1-2, a prior art speaker microphone 100 has a front casing 102 connected to a back casing 103, enclosing speaker 112 and all necessary electronics and wirings therein. The prior art speaker microphone 100 has a push-to-talk (PTT) button 104, a cable 105, and a clothes clip 106. A front grille 107 is provided on the front casing 102. Front casing 102 and back casing 103, both of which are made of hard plastic material, defines the housing.

Figure 3:
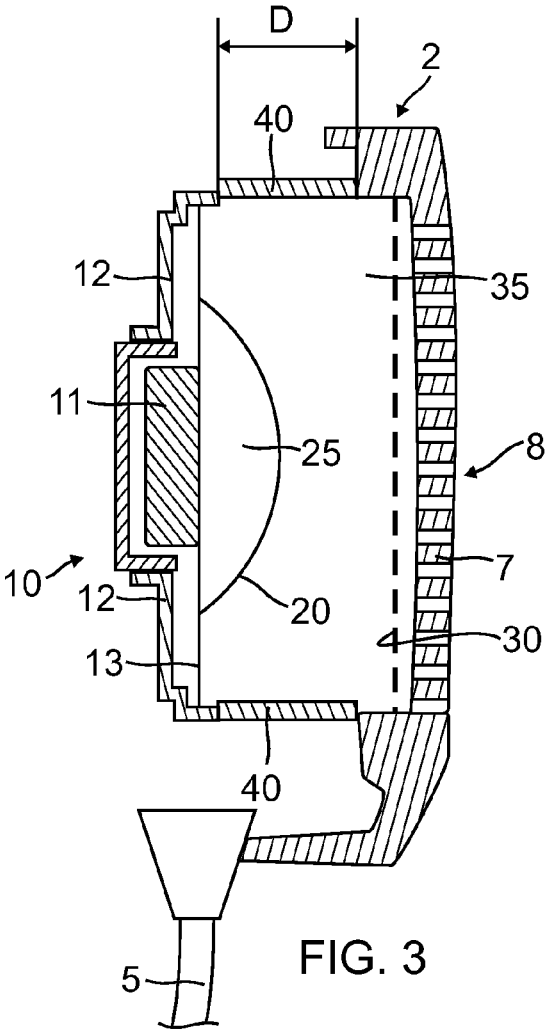
FIG. 3 is a side cross-sectional view of one embodiment of the anti-interference speaker microphone according to an aspect of the inventive subject matter, implementing both types of barrier cover, and having a clearance space D.

FIG. 3 shows one preferred embodiment of the novel and improved speaker microphone. On its outside it can look just like the prior art speaker microphone 100 of FIGS. 1 and 2. On its inside, it implements all three key components of the inventive subject matter.

The first key component is having a dome-shaped structure 20, being the first type of barrier cover, sealingly attached to the diaphragm 13 of the speaker 10. Diaphragm 13 is supported by speaker frame 12. The second key component is having a membrane 30 (i.e., the second type of barrier cover) attached to the grille 7. The third key component implemented in this preferred embodiment is having a ring spacer 40 located between the grille 7 and the speaker 10, thus creating a clearance space D. Each of these three key components will be discussed in detail below. It should be particularly noted, that any single one of the three key components alone is sufficient to achieve the intended objectives independent of the other two key components. Some embodiments of the invention can implement only one of the three, or two of the three key components. Each of the three key components has its advantages and disadvantages, all of which will be discussed below. FIGS. 3, 5-10 show different embodiments with different permutations of these three main features implemented.

Dome-shaped structure 20 is hollow on its inside and generally has a convex side and a concave side. Its concave side faces the speaker, and its perimeter, or its rim, directly attaches to the diaphragm 13. The combination of diaphragm 13 and the dome-shaped structure 20 creates a closed chamber 25. Closed chamber 25 is preferably air tight. At the very least, closed chamber 25 is at least closed on the grille facing side, such that the dome-shaped structure 20 sufficiently prevents any fine metal particles 80 from entering through the dome-shaped structure 20 to reach into the closed chamber 25. The dome-shaped structure 20 can be attached to the diaphragm by adhesives. Alternatively, the dome-shaped structure (or any equivalent structure as described herein) can be made an integral part of diaphragm 13 as part of the diaphragm design.

One way of making the dome shaped structure is by slicing through a perfectly spherical hollow ball. For example, a dome structure having a rim diameter of 25 mm can be created out of slicing through, slightly off-center, (one skilled in the art would appreciate the right place to slice it) a hollow spherical ball having a diameter of 30 mm.

Figure 5:
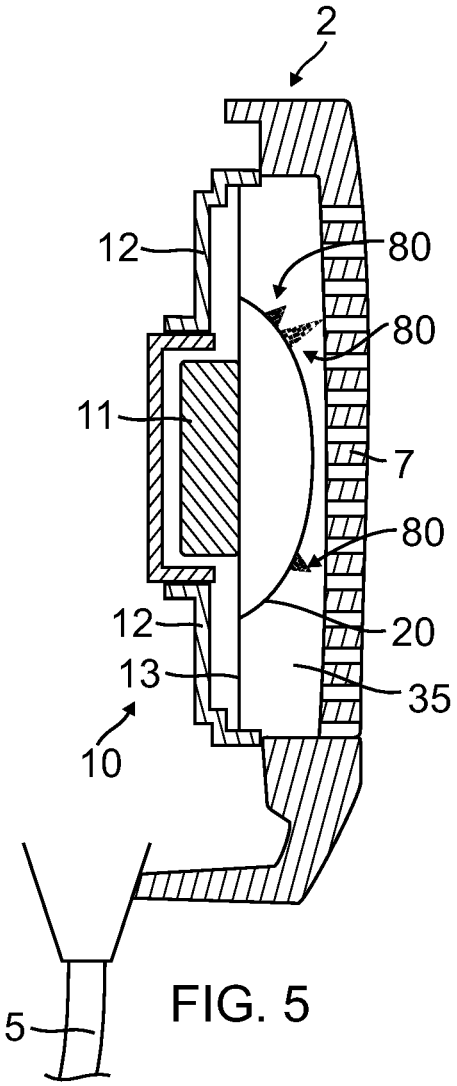
FIG. 5 is a side cross-sectional view of another embodiment of the anti-interference speaker microphone according to an aspect of the inventive subject matter, implementing a first type of barrier cover using a dome-shaped shell structure, and without a clearance space D.

As shown in another embodiment of FIG. 5, the closed chamber 25 effectively creates an added distance between fine metal particles 80 and the permanent magnet 11.

In one embodiment, this added distance is at least equal to or larger than a thickness of the permanent magnet 11. As a result, fine metal particles 80, is now in the range of sufficiently weak magnetic field to be attracted towards the permanent magnet 11 or magnetic gap G. One skilled in the art would immediately recognize that whether or not there remains to be sufficiently strong magnetic field to attract fine metal particles 80 is largely depended on the strength/size of permanent magnet 11, and on the volume/height/thickness of the closed chamber 25 (which is partially depended on the size and shape of the dome-shaped structure 20). Suppose, for the purpose of illustration, that there are fine metal particles 80 present in space 35 between the grille 7 and the dome-shaped structure 20, the goal of the dome-shaped structure 20 is to keep these fine metal particles as far away from the permanent magnets as possible, without seriously jeopardizing quality of sound projected from the diaphragm 13 and transmitted through the dome-shaped structure 20. A good rule of thumb, in most embodiments, is for the dome-shaped structure 20 to have a diameter not larger than the diameter X of the diaphragm, and not smaller than the circular magnetic gap G (or diameter K, see FIGS. 14-16). In other embodiments, the dome-shaped structure 20 is to have a diameter not larger than the diameter X, and not smaller than the diameter K (see FIGS. 11-13) of the permanent magnet.

Figure 16:
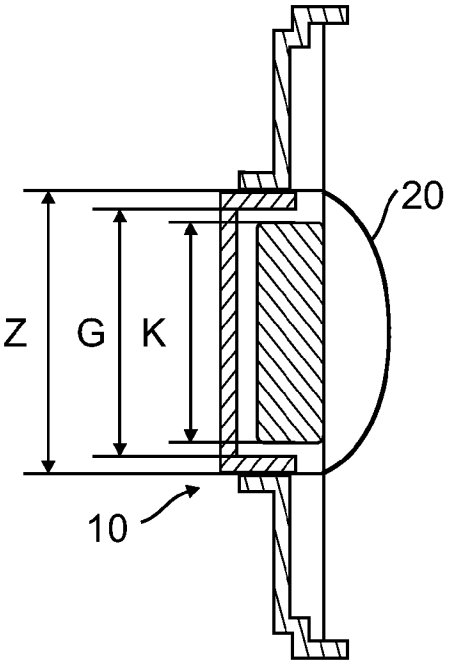
FIG. 16 is a side cross-sectional view showing yet another contemplated size of the shell structure relative to the diaphragm, according to one aspect of the inventive subject matter.
Figure 15:
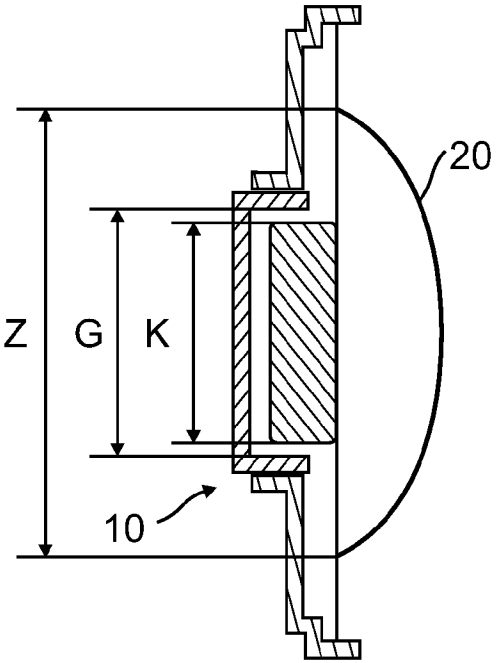
FIG. 15 is a side cross-sectional view showing another contemplated size of the shell structure relative to the diaphragm, according to one aspect of the inventive subject matter.
Figure 14:
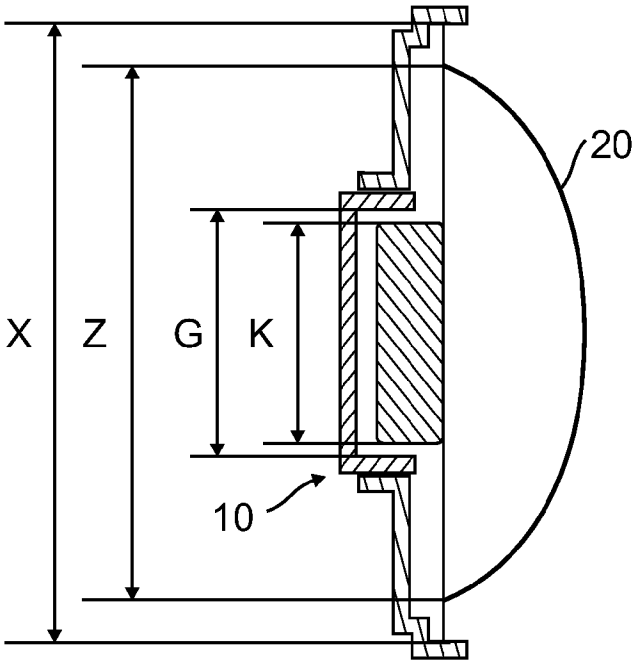
FIG. 14 is a side cross-sectional view showing a size of the shell structure relative to the diaphragm, according to one aspect of the inventive subject matter.

Referring now to FIGS. 14 to 16, in one embodiment, the inventors have discovered that the optimal ratio of circular magnetic gap G to the diameter Z of the dome-shaped structure 20 is between 1:1.50 to 1:2; more preferably, 1:1.75 to 1:1.8; even more preferably, 1:1.75. In any design, the diameter Z of the shell structure 20 must not be larger than the diameter X of the speaker diaphragm 13. The inventors have discovered that when the diameter Z of the shell structure 20 is equal to, or larger than, the diameter X of the speaker diaphragm, the objective of keeping fine metal particles sufficiently away from the permanent magnet 11 is achieved but the sound wave projected from the diaphragm is significantly distorted, resulting in a significantly higher pitch sound than actual sound. Thus, preferred sizes of the dome-shaped structure 20 is contemplated to have a diameter Z smaller than the diameter X of the diaphragm 13. In further preferred embodiments, the ratio of the diameter X of the diaphragm to the diameter Z of the dome-shaped structure 20 is between 1:0.5 to 1:0.9; more preferably, between 1:0.6 to 1:0.8, even more preferably, between 1:0.7 to 1:0.8.

In other embodiments, the optimal ratio of diameter K of the permanent magnet 11 to the diameter Z of the dome-shaped structure 20 is between 1:1.50 to 1:2; more preferably, 1:1.75 to 1:1.8; even more preferably, 1:1.75. In any design, the diameter Z of the shell structure 20 must not be larger than the diameter X of the speaker diaphragm 13.

In one preferred aspect of the inventive subject matter, the dome-shaped structure 20 has degrees of curvature that represents a portion of a perfect sphere. Alternatively, contemplated dome-shaped structure 20 (or any equivalent structure as will be discussed) may also be prepared from polymeric material, polyester, graphite, paper, etc.

In operation, it is important that the dome-shaped structure 20 has a light weight, and has a thickness that permit sound waves projected from the diaphragm to travel therethrough, or a thickness that permits the dome-shaped structure 20 to vibrate along with the diaphragm 13 to produce sound. In theory, the thinner the better, so long as it is structurally strong enough to support the force exerted upon it by fine metal particles that may still be attracted to the permanent magnet 11. Contemplated shell structure 20 is designed to vibrate with the diaphragm 13. The lighter and smaller the shell structure 20 is, the less it would negatively affect sound transmission. At any rate the shell structure 20 must not have a diameter K smaller than the magnetic gap G, or smaller than diameter K of the magnet 11, and must not have a diameter K equal to or larger than the diameter X of the diaphragm 13.

In further preferred embodiments, the dome-shaped structure 20 is made of polyester, has a diameter of 25 mm, and a thickness of 0.15 mm, and is light enough yet strong enough to sustain a weight of at least up to 75 g placed on top of the dome-shaped structure 20 without collapsing. In other preferred embodiments, the dome-shaped structure 20 has a diameter equal to or less than 24 mm, but larger than the magnetic gap G (or diameter K). In still other preferred embodiments, the dome-shaped structure 20 has a diameter Z equal to or less than 20 mm, but larger than the magnetic gap G (or diameter K). In further preferred embodiments, the dome-shaped structure 20 has a diameter Z equal to or less than 15 mm, but larger than the magnetic gap G (or diameter K).

Figure 13:
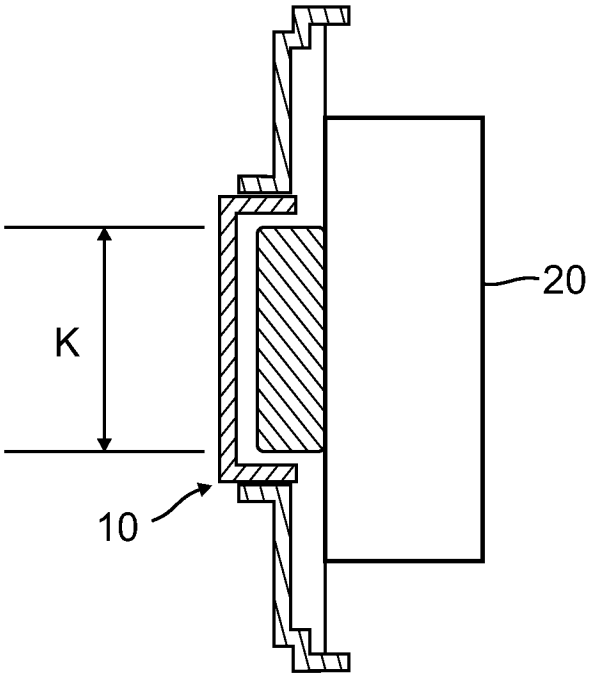
FIG. 13 is a side cross-sectional view showing the shape of a closed top cylindrical-shaped shell structure, according to one aspect of the inventive subject matter.
Figure 12:
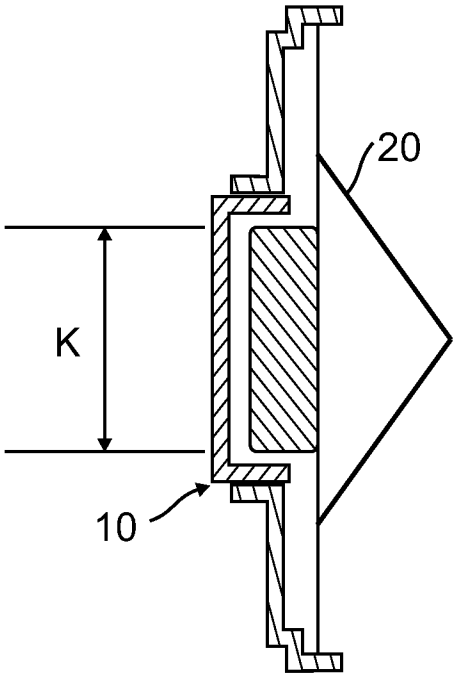
FIG. 12 is a side cross-sectional view showing the shape of a cone-shaped shell structure, according to one aspect of the inventive subject matter.
Figure 11:
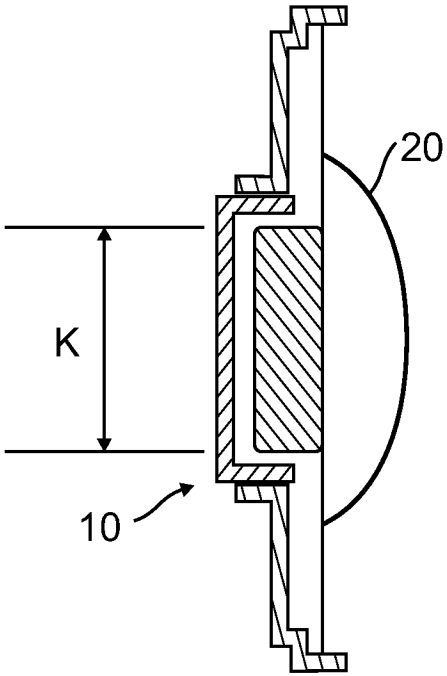
FIG. 11 is a side cross-sectional view showing the shape of a dome-shaped shell structure, according to one aspect of the inventive subject matter.

The preferred shape of shell structure 20 has a dome-shape, because the dome-shape equally distributes weight and responds well in transmitting sound waves projected from the diaphragm. Other shapes, however, are also contemplated and can be used. FIGS. 11-13 illustrate the three contemplated shapes. FIG. 11 shows cross-sectional view of a dome shape. FIG. 12 shows cross-sectional view of a cone shape 36. And, in FIG. 13, a cylindrical shape having side wall 37 and a flat top 38 is provided as a possible alternative to the dome-shaped structure 20. Also contemplated are frusto-conical shapes with a closed top. In all contemplated shapes, the shell structure has an outer rim that attaches to the diaphragm 13, and in a preferred embodiment, the outer rim has a diameter Z of 25 mm. In other preferred embodiments, the outer rim has a diameter Z equal to or less than 24 mm, but larger than the magnetic gap G (or diameter K). In still other preferred embodiments, the outer rim has a diameter Z equal to or less than 20 mm, but larger than the magnetic gap G (or diameter K). In further preferred embodiments, the outer rim has a diameter Z equal to or less than 15 mm, but larger than the magnetic gap G (or diameter K).

As those of ordinary skill in the art will recognize, the key feature of this first barrier cover is to provide a cover 20 disposed over the diaphragm 13, yet the cover 20 is to have the physical property to block entry of fine metal particles 80, sustain weight and force of the fine metal particles as attracted by the permanent magnet 11/magnetic gap G, and at the same time have minimum effect on sound quality, as sound is projected from the diaphragm. The wrong material, size, shape, and thickness can undesirably muffle sound projected from the diaphragm 13. The ranges, thickness, material, and shapes described above would enable one skilled in the art to produce a barrier cover suitable for a typical 1.5 inch or 2 inch small speakers found in speaker microphones.

And as those of ordinary skill in the art will recognize, any prior art speaker inside of any prior art speaker microphones may readily be modified as described above. Thus, this inventive subject matter specifically covers the method of retrofitting existing prior art speaker microphones.

The above described shell structure 20 may in some way appear similar to a regular dust cap in common home speakers. Some speakers are known to utilize a cone diaphragm and a dust cap to cap off the center opening of the cone diaphragm to keep dust away from its magnetic gap. Dust caps are not known to be larger than the magnetic gap, and are not known to be adhered to the front surface of a speaker diaphragm as disclosed. Further, common knowledge teaches one skilled in the art away from having an enlarged dust cap in these speakers because an enlarged dust cap would interfere with vibration of the cone diaphragm. Also, there is no incentive or motivation for one skilled in the art to enlarge the diameter of a regular dust cap, because a small one is sufficient for the purpose of preventing entry of fine dust, yet allowing the cone diaphragm to vibrate without interference.

Referring now to the second key component of the inventive subject matter, which is having a membrane 30 as a barrier cover to prevent, eliminate, and/or minimize interference caused by fine metal particles 80. This second type of barrier cover is a membrane, and can be used as an alternative or in addition to, the first type of barrier cover (i.e., the dome-shaped structure 20 and its equivalents).

Membrane 30 is illustrated in the figures in dash lines only to distinguish it from adjacent lines in the drawing figures, one skilled in the art would immediately understand that such dash line is not meant to define the membrane 30 as perforated or containing openings in any way.

In FIG. 3, a membrane 30 is disposed directly on the inside of the grille 7, to cover over openings 8 of grille 7. In one embodiment, membrane 30 is sealingly attached to the back of the grille 7 by suitable adhesives. Membrane 30 may be ordered from its manufacturer with adhesives already applied to the perimeter region of one side, so that the membrane can be readily applied/adhered to the back side of the grille.

Not all membranous material is suitable because some membranous material can negatively affect sound transmission, muffle sound, and/or create wanted noise. In the preferred embodiment, the membrane is a rubber film, and the most preferred embodiment, the membrane 30 is Bayer® film (available at http://www.bayerfilms.com/, Bayer MaterialScience, LLC, 8 Fairview Way, South Deerfield, Mass. 01373, U.S.A.). In other preferred embodiments, the membrane is specifically Dureflex® Thermoplastic Polyurethane (TPU) Films (available at http://www.bayerfilms.com/, Bayer MaterialScience, LLC, 8 Fairview Way, South Deerfield, Mass. 01373, U.S.A.). In yet other preferred embodiments, the membrane 30 is specifically Makrofol® thermoplastic polycarbonate (PC) films (available at http://www.bayerfilms.com/, Bayer MaterialScience, LLC, 8 Fairview Way, South Deerfield, Mass. 01373, U.S.A.). In still yet other preferred embodiments, the membrane 30 is a blended films made from polycarbonate and other engineering thermoplastics such as ABS. In some preferred embodiments, the membrane 30 is specifically Bayfol® polycarbonate blended film (available at http://www.bayerfilms.com/, Bayer MaterialScience, LLC, 8 Fairview Way, South Deerfield, Mass. 01373, U.S.A.). In still yet other preferred embodiments, the membrane 30 is a Makrofol® coated film (available at http://www.bayerfilms.com/, Bayer MaterialScience, LLC, 8 Fairview Way, South Deerfield, Mass. 01373, U.S.A.).

Characteristics of suitable membrane 30 include having a thickness sufficiently thin so as not to substantially affect transmission of sound wave therethrough.

One disadvantage of using membrane 30 is that hot fine metal particles can melt through it. Despite such possibility, membrane 30 remains to be a novel and innovative way to keep fine metal particles out of the interior of the speaker microphone housing.

Figure 6:
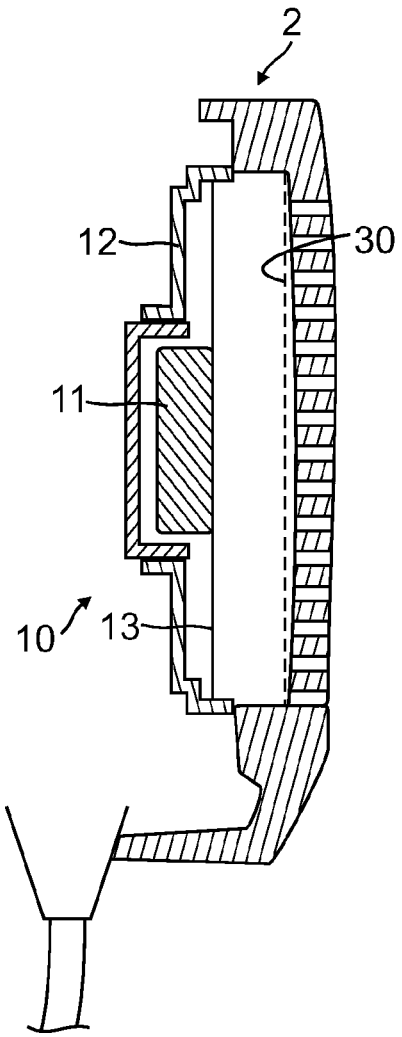
FIG. 6 is a side cross-sectional view of yet another embodiment of the anti-interference speaker microphone according to an aspect of the inventive subject matter, implementing a second type of barrier cover using a membrane, and without a clearance space D.
Figure 7:
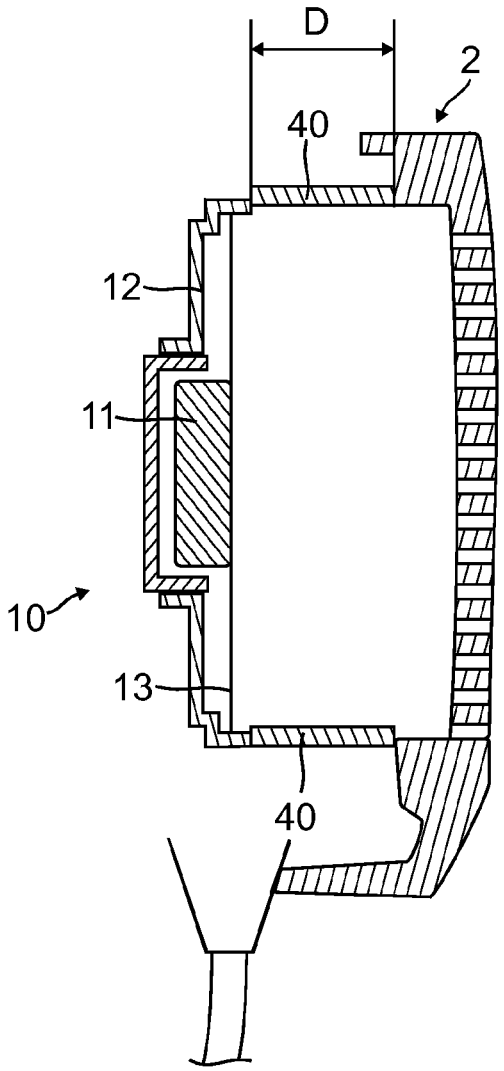
FIG. 7 is a side cross-sectional view of a further embodiment of the anti-interference speaker microphone according to an aspect of the inventive subject matter, implementing a ring spacer to create a clearance space D alone, without any barrier cover.
Figure 8:
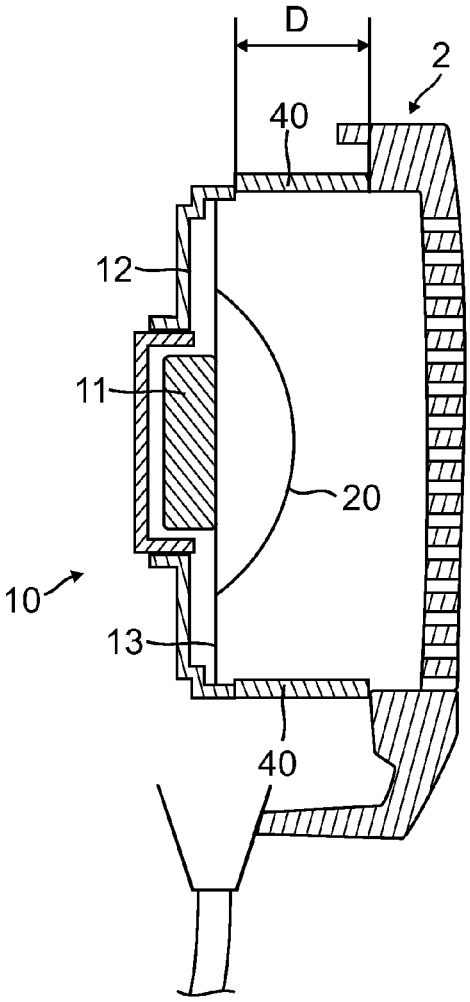
FIG. 8 is a side cross-sectional view of a further embodiment of the anti-interference speaker microphone according to an aspect of the inventive subject matter, implementing a ring spacer to create a clearance space D alone, with a dome-shaped structure.
Figure 9:
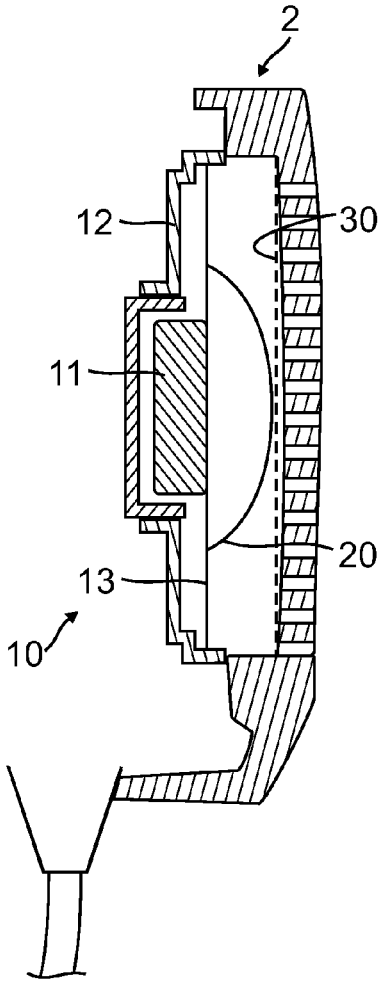
FIG. 9 is a side cross-sectional view of a further embodiment of the anti-interference speaker microphone according to an aspect of the inventive subject matter, implementing a dome-shape structure and a membrane.
Figure 10:
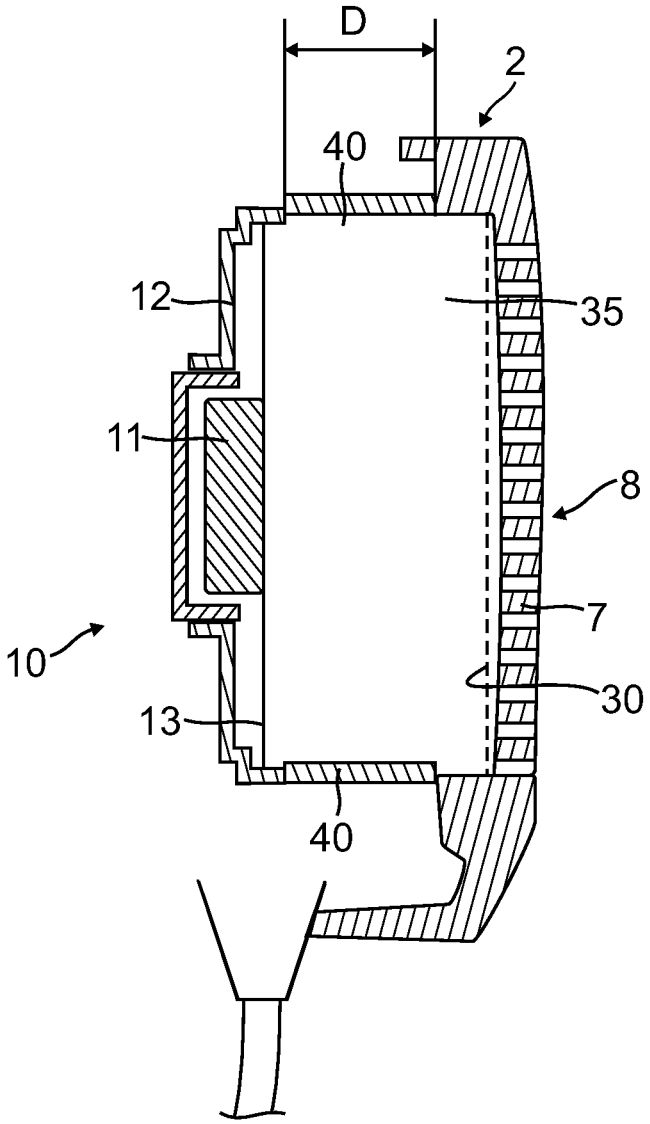
FIG. 10 is a side cross-sectional view of a further embodiment of the anti-interference speaker microphone according to an aspect of the inventive subject matter, implementing a ring spacer and a membrane.

FIG. 6 illustrates one embodiment where membrane 30 alone is used to achieve the intended objective.

It should be noted that although the location of the membrane 30 is illustrated and discussed as being placed over the inside of the grille 7, other locations are also contemplated.

In one embodiment, membrane 30 can wrap around the outside of the speaker microphone 100, or specifically wrap around and covering the outside of the grille 7.

Membrane 30 can also be placed at some distance between the grille 7 and the diaphragm 13. For example, it can be placed on a ring spacer 40, as will be discussed below.

Referring again to FIGS. 3, 7, 8, and 10, the third key component of the contemplated inventive subject matter is to increase the distance between the diaphragm 13 and the grille 7. In prior art speaker microphones as illustrated in FIG. 2, speaker 110 is placed directly behind the grille 7. This is the preferred design in the industry, because by being closely behind the grille 7, sound is able to escape the speaker microphone housing 102 with minimal muffled sound. It is known in the audio equipment industry that speakers are to be installed directly behind the grille, facing outwardly of its housing for best sound transmission. Prior art knowledge provides that speaker are not installed further back into its housing, because sound would otherwise undesirably resonate within the housing 102 (unless, the speaker is a woofer).

Figure 4:
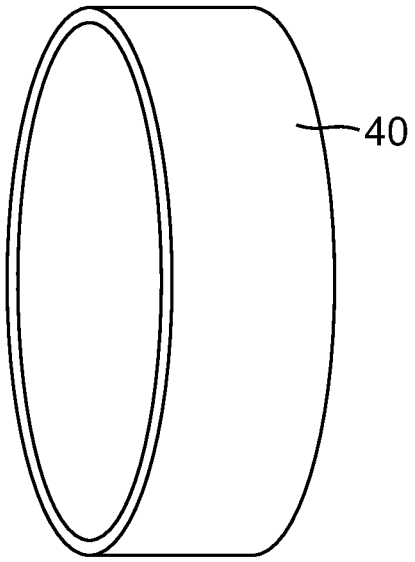
FIG. 4 is a perspective view of a ring spacer from the embodiment of FIG. 3, according to an aspect of the inventive subject matter.

Here, the inventors have discovered a novel design contrary to commonly known speaker construction. More specifically, a novel design contrary to commonly known ways to position a speaker inside of speaker microphone housing. In FIGS. 3, 7, 8, and 10, an added distance D is provided in between speaker 10 and grille 7. This added distance D is made possible by inserting a ring spacer 40 (FIG. 4) behind the grille 7. This ring spacer 40 generally has a diameter similar to that of the speaker frame 10. One skilled in the art would immediately recognize many other ways to make this possible. For example, front casing 2 can be specifically molded to include such spacer, or have structures to position the speaker 10 further back as illustrated. The ring spacer 40 is preferable because its side wall abuts against the front casing 2 on one side, and abuts against the speaker 10 on the other side, leaving virtually no room for any fine metal particle 80 to fall through and travel around to reach the back of the speaker 19. In some preferred embodiments, the ring spacer 40 is sealingly attached to the front casing 2 and to the speaker 10. The seal can be an adhesive, or an additional sealant applied in appropriate areas.

Contemplated ring spacer 40 has a diameter of 40.5 mm, a height of 13.5 mm, and thickness of 2.5 mm. It is tubular with a through passage.

As discussed above, common practice requires that speakers be positioned outwardly towards and directly behind the grille 7, and not further back into its housing. The illustration as shown in FIGS. 3, 7, 8, and 10 the ring spacer 40 essentially creates a tunnel. Too long of such tunnel can cause unwanted muffling. Here, the inventors have discovered that in the preferred embodiment, the optimal distance D is between 5 mm to 15 mm Preferably, distance D is 10 mm.

This method of including a distance D can independently provide improved characteristic of minimizing entry of fine metal particles. Distance D dramatically lowers the magnetic attraction at the front of the grille 7, such that fine metal particles 80 in the ambient environment are no longer, or much less, attracted by the magnetic field of the permanent magnet 11.

As mentioned above, membrane 30 can be attached to one or both sides of the ring spacer 40, such that when ring spacer 40 is in its intended position within the speaker microphone housing, the membrane 30 would effectively block any passage of fine metal particles 80 passing through the interior of the ring spacer 40.

Many alterations and modifications may be made by those having ordinary skill in the art without departing from the spirit and scope of the above discussed three key components to the invention. Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed herein even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims therefore include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

As used herein, the term "shell" in conjunction with the first barrier cover 20 refers to relatively rigid, hard structure when compared to the second barrier cover 30, which is a relatively soft and pliable membrane 30. The shell may or may not be resilient. The term shell also is not meant to define a particular thickness or density. The term "shell" is merely being used to indicate a physical property relative to a soft, pliable membrane 30.

As used herein, the term "fine metal particles" refers to any particles of any size and any material that are known to attract to permanent magnets inside of speaker microphones during the environments that such speaker microphones are known to be used in.

As used herein, the term "speaker microphone" refers to an accessory to a two-way radio, whether or not it is connected to the two-way radio by wire or wirelessly. All of the contemplated speaker microphone may or may not have a push to talk (PTT) button.

Thus, specific embodiments and applications of anti-interference speaker microphone have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as being equivalent within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what essentially incorporates the essential idea of the invention. In addition, where the specification and claims refer to at least one of something selected from the group consisting of A, B, C . . . and N, the text should be interpreted as requiring only one element from the group, not A plus N, or B plus N, etc.

What is claimed is:

1. An anti-interference speaker microphone for a two-way radio, the speaker microphone comprising:

a body having an outer casing, wherein the outer casing has a front grille and a back portion;

a speaker enclosed within said outer casing, said speaker has a flat diaphragm which has an outer circumference and a diameter X;

said speaker has a magnet and a voice coil coupled to the diaphragm, wherein the flat diaphragm is disposed between the front grille and the magnet, and the magnet creates a magnetic gap;

a barrier cover disposed between the front grille and the flat diaphragm and is sealingly coupled to the flat diaphragm to create a closed chamber defined as a space between the flat diaphragm and the barrier cover, wherein the closed chamber is airtight and is physically sealed to prevent entry of the plurality of fine metal particles into the closed chamber, and wherein the closed chamber is defined by the flat diaphragm on one side and the barrier cover on the other side;

wherein the barrier cover is comprised of one selected from a group consisting of a dome structure, a cone structure, and a short cylindrical structure, and wherein the barrier cover has a circular outer rim having a diameter Z, wherein diameter Z is equal to or less than 25 mm, and larger than the magnetic gap;

wherein the diaphragm has a vibrating surface defined as a surface between its outer rim and where the diaphragm is attached to the voice coil;

wherein the circular outer rim of the barrier cover is attached directly on the vibrating surface.

2. The speaker microphone as recited in claim 1, wherein the barrier cover is comprised of the dome structure, and the dome structure has a concave side and convex side, wherein the convex side of the dome structure faces the front grille, and concave side of the first barrier faces the diaphragm.

3. The speaker microphone as recited in claim 1, wherein the speaker is sized 2 inches or smaller.

4. The speaker microphone as recited in claim 1, wherein the speaker is disposed further away from the front grille of the outer casing so as to provide a distance of at least 10 mm between the outer circumference of the diaphragm and an inner-facing side of the front grille.

5. The speaker microphone as recited in claim 2, wherein the dome structure is comprised of polyester, and wherein the speaker is sized 2 inches or smaller.

6. The speaker microphone as recited in claim 5 further comprising a second barrier cover being a membrane sealingly disposed between the diaphragm and the front grille so as to prevent passage of said plurality of fine metal particles therethrough.

7. A two-way radio system comprising the speaker microphone as recited in claim 5.

8. The speaker microphone as recited in claim 6, wherein the membrane is a Bayer® film, and it is disposed directly on a back side of the grille.

9. The speaker microphone as recited in claim 4, further comprising a ring spacer disposed between the speaker and the front grille.

10. A method of prolonging a functional lifespan of a speaker microphone in a two-way radio system against deteriorating effects of environmental fine metal particles, the method comprising:

providing a speaker microphone having a casing with a front grille, and a speaker disposed within the casing;

wherein the speaker has a flat diaphragm, a voice coil, a permanent magnet coupled to the diaphragm creating a magnetic gap, wherein the diaphragm is located between the magnet and the front grille;

providing a first barrier cover between the front grille and the flat diaphragm and the first barrier cover is sealingly coupled to the flat diaphragm to create a closed chamber defined as a space between the flat diaphragm and the first barrier cover, wherein the closed chamber is airtight and is physically sealed to prevent entry of the plurality of fine metal particles into the closed chamber, and wherein the closed chamber is defined by the flat diaphragm on one side and the first barrier cover on the other side;

physically preventing passage of a plurality of said fine metal particles therethrough; and wherein the first barrier cover is a comprised of one selected from a group consisting of a dome structure, a cone structure, and a short cylindrical structure;

wherein the first barrier cover has a circular outer rim having a diameter Z, wherein diameter Z is equal to or less than 25 mm, and larger than the magnetic gap;

wherein the diaphragm has a vibrating surface defined as a surface between its outer rim and where the diaphragm is attached to the voice coil;

wherein the circular outer rim of the first barrier cover is attached directly on the vibrating surface.

11. The method as recited in claim 10, further providing a second barrier cover disposed between the diaphragm and the grille, and the second barrier cover is a membrane.

12. The method as recited in claim 10, further comprising keeping a distance of at least 10 mm between the magnet and the grille.

13. The method as recited in claim 10, wherein the diameter Z is equal to or less than 25 mm.

14. The method as recited in claim 11, wherein the diameter Z is equal to or less than 25 mm.

15. The method as recited in claim 11, wherein the membrane is a Bayer® film adhered to a back side of the front grille.

16. The method as recited in claim 13, wherein the first barrier cover is a dome-shaped structure, and the speaker is sized 2 inches or smaller.

17. The method as recited in claim 16, wherein the diameter Z is equal to or less than 20 mm, and larger than a diameter K of the magnet.

* * * * *